US006375586B1

(12) United States Patent
Cousins et al.

(10) Patent No.: US 6,375,586 B1
(45) Date of Patent: Apr. 23, 2002

(54) ARROW IMPACT-ENHANCER AND METHODS

(75) Inventors: Martin A. Cousins; Jerry E. Grose, both of Huntsville, AL (US)

(73) Assignee: Highlander Sports, Inc., Huntsville, AL (US)

( * ) Notice: Subject to any disclaimer, the term of this patent is extended or adjusted under 35 U.S.C. 154(b) by 0 days.

(21) Appl. No.: 09/706,357

(22) Filed: Nov. 6, 2000

(51) Int. Cl.[7] ..... F42B 6/04
(52) U.S. Cl. ..... 473/578
(58) Field of Search ..... 473/578

(56) References Cited

U.S. PATENT DOCUMENTS 3,759,519 A * 9/1973 Palma ..... 475/578
4,900,038 A * 2/1990 Czetto et al. ..... 473/578 X
5,141,229 A * 8/1992 Roundy ..... 473/578 X

* cited by examiner

*Primary Examiner*—John A. Ricci
(74) *Attorney, Agent, or Firm*—Nixon & Vanderhye P.C.

(57) ABSTRACT

Devices increase an arrow's kinetic energy, and hence the force on target impact, without a substantial decrease in the velocity of the arrow as compared to the same arrow without such devices. In especially preferred forms, the impact-enhancing devices are insertable into an arrow shaft and include an impact-enhancer weight which is freely moveable within the arrow shaft. The impact-enhancer weight will thus be propelled in response to rapid deceleration of the arrow (i.e., caused by the arrow head striking a target area). The relatively high velocity movement of the impact-enhancer weight will create a secondary kinetic energy effect which drives the arrow head further into the target area. That is, the impact-enhancer weight will be propelled forwardly at a sufficiently high velocity and strike a rearward region adjacent the arrow head thereby generating a secondary impact force (i.e., secondary to the initial target impact of the arrow itself) causing the arrow head to penetrate deeper into the target area. In such a manner, the effect of the arrow head is enhanced.

33 Claims, 3 Drawing Sheets

ARROW IMPACT-ENHANCER AND METHODS

FIELD OF THE INVENTION

The present invention relates generally to the field of archery products. More specifically, the present invention relates to devices which enhance the impact force of an arrow in response to a target strike.

BACKGROUND AND SUMMARY OF THE INVENTION

The impact force of an arrow when it strikes its target is dependent upon its kinetic energy in flight which is generally a function of the arrow mass and the speed at which the arrow travels. In more specific terms, the kinetic energy ($E_k$, ft-lb) of the arrow is equal to its mass (m, lbs) times the square of the arrow's velocity (V, ft/sec) divided by twice the acceleration due to gravity (g, ft/sec$^2$)—namely $E_k=mV^2/2g$. The mass of the arrow, however, should not be increased significantly as it would alter its flight characteristics. To increase the speed of the arrow, however, necessitates altering the bow configuration.

It would therefore be highly desirable if arrows were provided with a means by which their kinetic energy could be enhanced without substantially increasing the arrow weight thereby avoiding significantly adverse effects on the arrow's flight characteristics. It is towards providing such a need that the present invention is directed.

Broadly, the present invention is embodied in a device which significantly increases an arrow's kinetic energy, and hence the force on target impact, without a substantial decrease in the arrow's velocity during flight as compared to the same arrow without such a device. In especially preferred forms, the present invention is embodied in an impact-enhancing device which is insertable into an arrow shaft and includes an impact-enhancer weight which is freely moveable within the arrow shaft. The impact-enhancer weight will thus be propelled in response to rapid deceleration of the arrow (i.e., caused by the arrow head striking a target area). The relatively high velocity movement of the impact-enhancer weight will create a secondary kinetic energy effect which drives the arrow head further into the target area. That is, the impact-enhancer weight will be propelled forwardly at a sufficiently high velocity and strike a rearward region adjacent the arrow head thereby generating a secondary impact force (i.e., secondary to the initial target impact of the arrow itself) causing the arrow head to penetrate deeper into the target area. In such a manner, the effect of the arrow head is enhanced.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein.

DETAILED DESCRIPTION OF THE INVENTION

Figure 1:
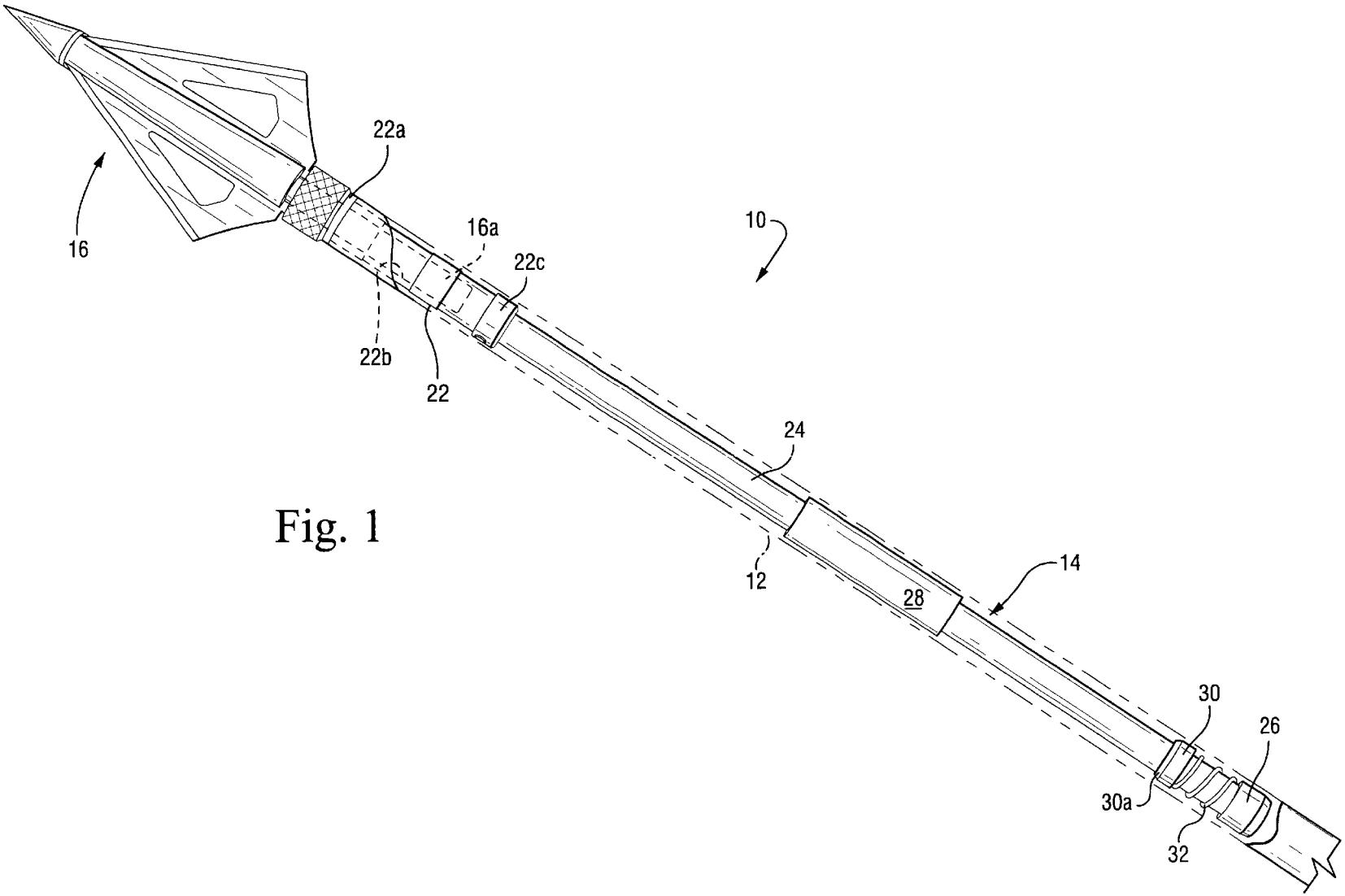
FIG. 1 is an enlarged cross-sectional view of a distal end of an arrow which includes an impact-enhancing device in accordance with the present invention.

Accompanying FIG. 1 generally depicts in partial cross-section a distal end of an arrow 10 having a shaft 12 which includes an impact enhancing device 14 positioned coaxially rearwardly of the arrow head 16. As is conventional, the proximal end of the arrow shaft 10 is provided with equally circumferentially spaced apart tail feathers 18 and a notched receiver 20 (see FIG. 3) to receive the bow string and thereby launch the arrow 10 towards its intended target area.

The impact-enhancing device 14 includes a distal connector 22 having an exterior circumference which is sized so as to be in friction fit relationship with the interior surface of the tubular arrow shaft 12. The forward end 22*a* of the connector 22 positioned adjacent the distalmost end of the tubular arrow shaft 12. An open-ended threaded cavity 22*b* extends from the forward end 22*a* internally of the connector 22 and threadably accepts a threaded stud 16*a* extending proximally from the arrow head 16. In such a manner, the arrow head 16 may be threadably connected to the connector 22 and hence the arrow shaft 12.

The proximal end 22*c* of the connector 22 is connected rigidly to a central guide shaft 24 which extends proximally therefrom and terminates in an end cap 26. A tubular impact-enhancer weight 28 (e.g., a section of a metal, for example brass, tubing) is coaxially sleeved over the guide shaft 24 and is freely moveable therealong between a proximal-most "armed" position (i.e., shown in solid line in FIG. 2A) and a distal-most "impact" position (i.e., shown by solid line in FIG. 2B). When in the "armed" position, the proximal end of the impact-enhancer weight is most preferably frictionally, but releasably, engaged with a retainer ring 30 moveably positioned coaxially over the shaft 24. More specifically, the retainer ring 30 will have a smaller diameter forward edge surface 30 a which frictionally engages the proximal end of the impact-enhancer weight 28 when in its "armed" position. A spring element 32 extends between the retainer ring 30 and the end cap 26 so allow the retainer ring to be moved proximally against the bias of the spring force.

Figure 2A:
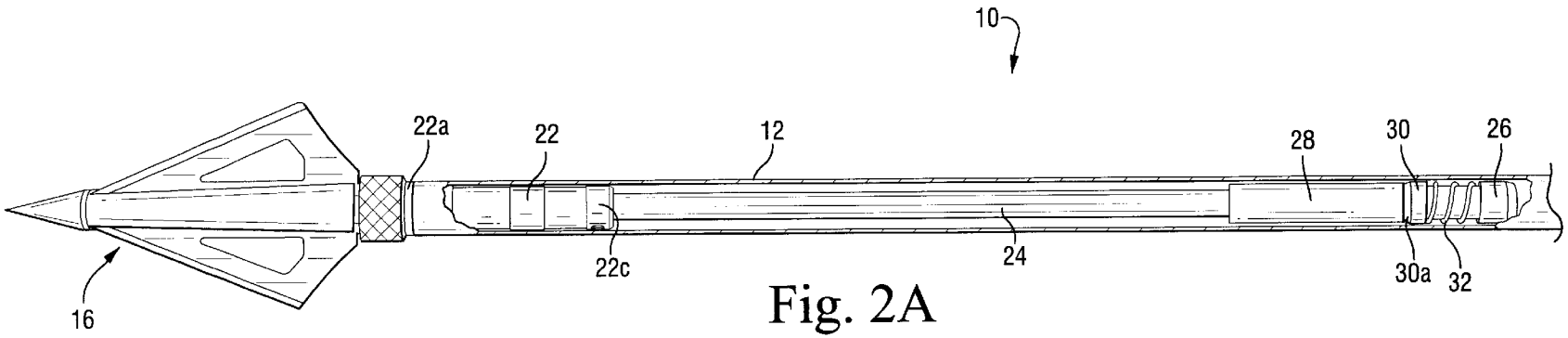
FIGS. 2A and 2B are each enlarged partial cross-sectional views of the distal end of the arrow show in FIG. 1 showing the impact-enhancer weight in its armed and impact conditions, respectively.
Figure 3:
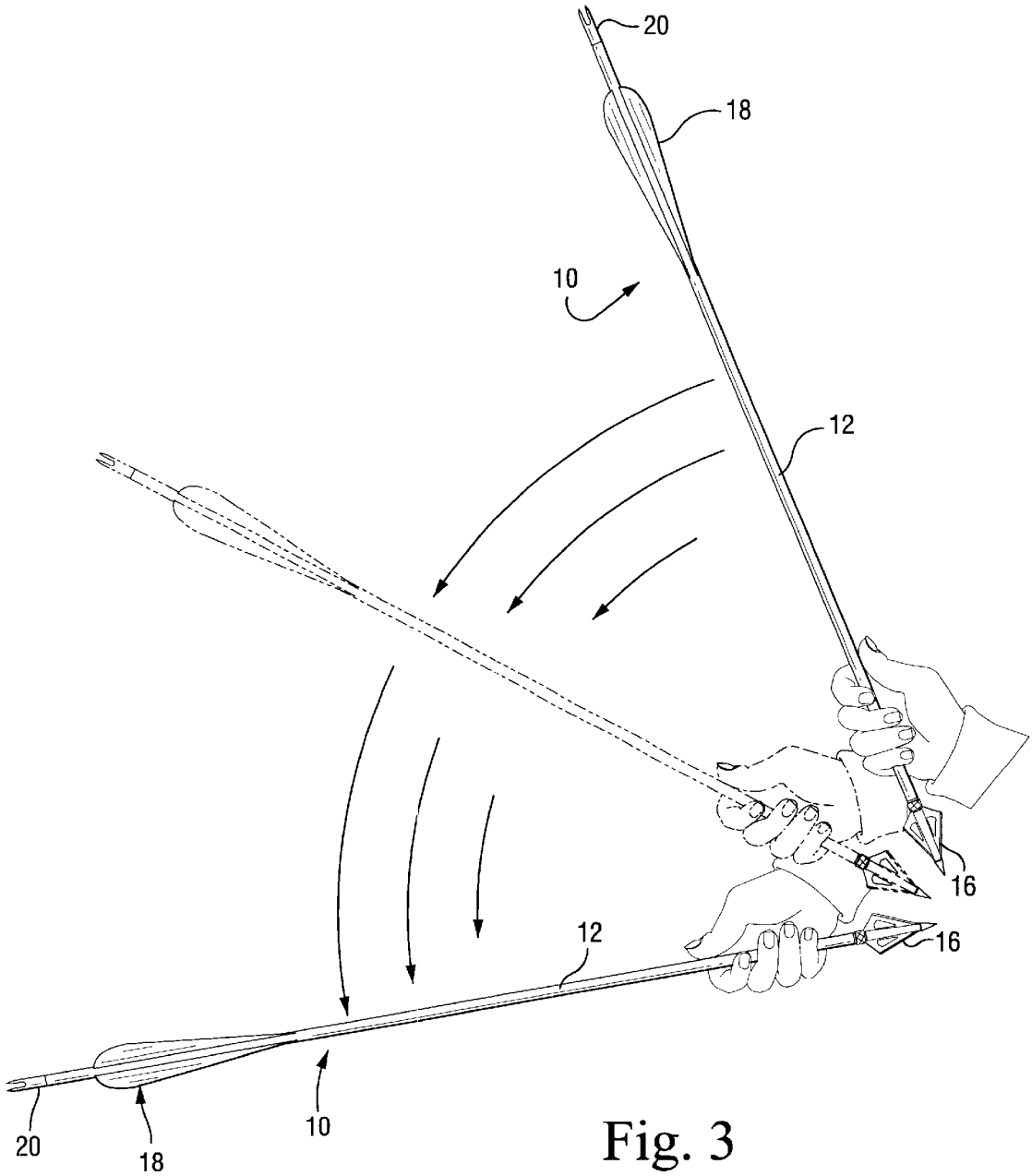
FIG. 3 is a schematic view showing a technique that may be employed to "arm" an arrow equipped with an impact-enhancing device of this invention.

In use, with particular reference to FIG. 3, it can be seen that the arrow 10 is "armed" by grasping the distal end of the arrow shaft 12 and then briskly flinging the arrow 10 through a generally arcuate path. This brisk movement of the arrow 10 creates a centrifugal force which causes the impact-enhancing weight 28 to be moved forcibly into contact with the edge 30*a* of retainer ring 30. In such a manner, therefore, the impact-enhancing weight 28 is frictionally retained by the retainer ring 30 in its "armed" condition as was noted above. Specifically, the armed condition of the impact-enhancing weight 28 is shown in FIG. 2A.

Figure 2B:
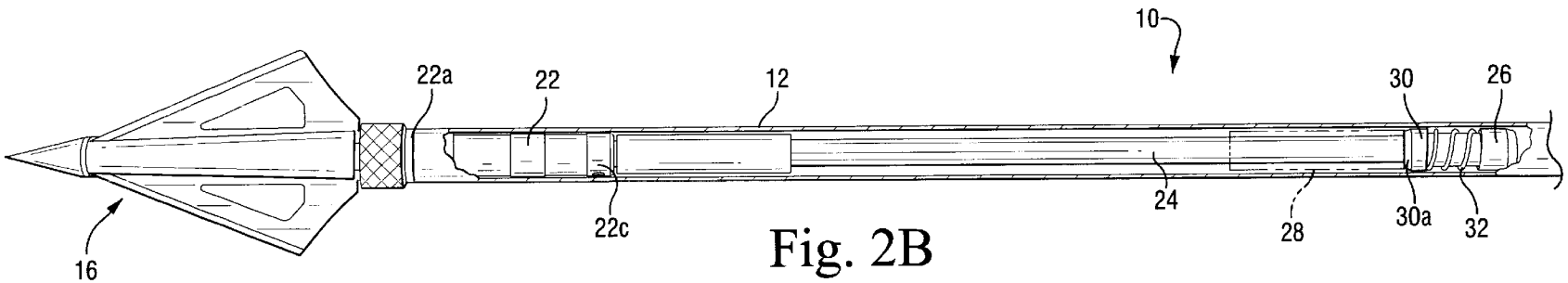

The archer may now shoot the "armed" arrow 10 as depicted in FIG. 2A from a conventional bow (not shown). The arrow 10 will, of course, abruptly decelerate upon striking the target area. The deceleration force is more than sufficient to release the light frictional engagement between the edge 30*a* of the retaining ring 30 and the impact-enhancing weight 28. As a result, the impact-enhancing weight will be propelled forwardly guided along the guide shaft 24 towards the rearward end 22*c* of the connector 22. The momentum of the propelled weight 28 striking the rearward end 22*c* of the connector 22 will thereby in turn impart a secondary impact force to the arrow head 16. The arrow head 16 is thus caused to penetrate deeper into the target area thereby enhancing its effect. Any recoil (or "bounce-back") of the impact-enhancing weight 28 from its distal impact position and to its proximal "armed" position after striking the rearward end 22*c* of the connector 22 (i.e., as shown by the phantom line position of the impact-enhancing weight 28 in FIG. 2B) is absorbed by the rearward movement of the retaining ring 30 against the bias force of the spring element 32. Thus, the spring element 32 acts as a shock-absorber of sorts to minimize forces tending to withdraw the arrow from the target area.

Figure 4:
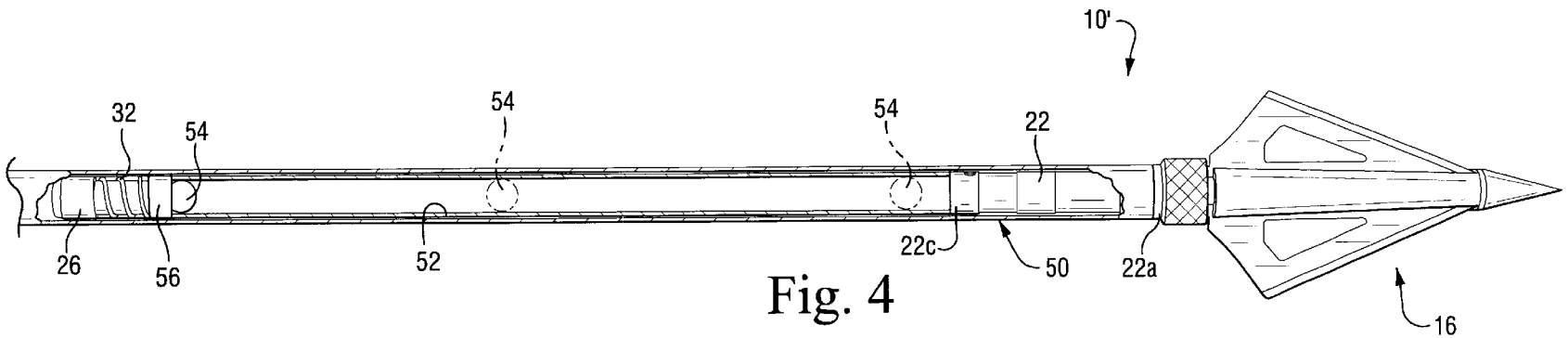
FIG. 4 is an enlarged cross-sectional view of an arrow which includes another embodiment of an impact-enhancing device in accordance with the present invention.

An alternative embodiment of an impact-enhancing device 50 associated with an arrow 10' in accordance with the present invention is shown in accompanying FIG. 4. As shown, the impact-enhancer device 50 includes a guide tube 52 extending rearwardly from the connector 22. A spherical impact-enhancing weight 54 is thus freely moveable within the guide tube 52 from its "armed" position, where it is frictionally, but releasably, held by a cup-shaped retainer 56 and an "impact" position, where it strikes the rear end 22*c* of the connector 22. On impact with a target, the spherical impact-enhancing weight 54 is released by the retainer 56 and propelled forwardly toward the rearward end 22*c* of the connector 22, guided by the guide tube 52. Thus, on striking the rearward end 22*c* of the connector 22, the spherical weight 54 will likewise serve to enhance the effect of the arrow 16 similar to that described in relation to the embodiment discussed previously.

Virtually any conventional arrow may be modified to receive the impact-enhancing device of the present invention. Thus, the impact-enhancing device may be sold to archers as a "retrofit" device where it is positioned operatively within a distal end of an arrow already in the archer's position. Alternatively, or additionally, arrows already having an impact-enhancing device of the present invention may be manufactured and sold by original equipment manufacturers. It also is clear to those in this art that the particular material from which the arrow shaft is made is not critical at all to the proper functioning of the present invention. Thus, the impact-enhancing device may be used with arrows having conventional aluminum or graphite shafts.

The impact-enhancing devices in accordance with the present invention has been found to substantially enhance the kinetic energy of arrows with minimal reduction in arrow velocity as compared to comparable arrows not including the device. Preferably, the devices of the present invention increase the kinetic energy of an arrow in an amount of at least about 20%, more preferably at least about 25%, in response to a target strike with a velocity reduction of the arrow in flight of less than about 5%, more preferably less than about 3%, as compared to a comparable arrow not including the device.

The present invention will be further understood from the following non-limiting Example.

EXAMPLE

An arrow having a PSE 300 Carbon Shaft and a 100 grain field point and fitted with an impact-enhancing device as depicted in accompanying FIG. 1 was shot toward a target through a standard chronograph to determine the velocity of the arrow in flight. The target was operatively associated with Brechbuhler Measurement and Calibration Instruments which measured weight in grams of the arrow, its speed in ft/sec, and the time delay between the initial impact of the arrow and the secondary impact attributable to the impact-enhancing device, and calculated the kinetic energy generated. For purpose of comparison, the same arrow without the impact-enhancing device of the present invention was similarly tested. The results appear below in Table 1:

TABLE 1

| | Arrow Speed | Kinetic Energy |
|---|---|---|
| Arrow without Invention: | 286 ft/sec | 68 ft-$lb_f$ |
| Arrow with Invention: | 278 ft/sec | 89 ft-$lb_f$ |
| Amt. Change with Invention: | −8 ft/sec | +21 ft-$lb_f$ |
| % Change with Invention: | −2.8% | +30.9 |

As can be seen from the data in Table 1, the arrow in accordance with the present invention exhibits substantially improved kinetic energy of 30.9% with a minimal velocity penalty of −2.8% as compared to the same arrow not equipped with the impact-enhancing device of the present invention.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A device to enhance impact of an arrow comprising:

a distal connector adapted to being operatively coupled to a distal end of an arrow shaft and to a forwardly projecting arrow head, an impact-enhancing weight adapted to be freely moveable within the arrow shaft to forcibly strike the connector in response to an abrupt deceleration force of the arrow, and a proximal retainer to frictionally, but releasably, retain the impact-enhancing weight in a proximal armed condition during flight of the arrow toward a target area.

2. The device of claim 1, further comprising a guide shaft connected at a distal end thereof to said connector and having a retainer ring at a proximal end thereof.

3. The device of claim 2, wherein said impact-enhancing weight is generally cylindrical and sleeved over said guide shaft for movement between a proximal armed position, wherein the weight is frictionally, but releasably, retained by said retainer ring, and a distal impact position, wherein the weight impacts said connector.

4. The device of claim 3, further comprising a spring member acting upon said retainer ring, wherein said retainer ring is moveable along said guide shaft against the bias force of said spring member.

5. The device of claim 1, further comprising a guide tube connected at a distal end thereof to said connector and having a retainer at a proximal end thereof to frictionally, but releasably, retain said impact-enhancing weight, and wherein said impact-enhancing weight is a ball which is freely moveable within said guide tube.

6. The device of claim 5, further comprising a spring member acting upon said retainer, wherein said retainer is moveable along said guide shaft against the bias force of said spring member.

7. An arrow comprising:

an elongate arrow shaft having an arrow head at a distal end of the arrow shaft, and arrow feathers at a proximal end of the arrow shaft; and an impact-enhancing device operatively connected to the distal end of the arrow shaft rearwardly of the arrow head, said impact-enhancing device including, (i) a distal connector which is connected to said distal end of said arrow shaft and to said arrow head, (ii) an impact-enhancing weight freely moveable within said arrow shaft to forcibly strike the connector in response to the arrow head striking a target area, and (iii) a proximal retainer to frictionally, but releasably, retain the impact-enhancing weight in a proximal armed condition during flight of the arrow toward a target area.

8. The device of claim 7, further comprising a guide shaft connected at a distal end thereof to said connector and having a retainer ring at a proximal end thereof.

9. The device of claim 8, wherein said impact-enhancing weight is generally cylindrical and sleeved over said guide shaft for movement between a proximal armed position, wherein the weight is frictionally, but releasably, retained by said retainer ring, and a distal impact position, wherein the weight impacts said connector.

10. The device of claim 9, further comprising a spring member acting upon said retainer ring, wherein said retainer ring is moveable along said guide shaft against the bias force of said spring member.

11. The device of claim 7, further comprising a guide tube connected at a distal end thereof to said connector and having a retainer at a proximal end thereof to frictionally, but releasably, retain said impact-enhancing weight, and wherein said impact-enhancing weight is a ball which is freely moveable within said guide tube.

12. The device of claim 11, further comprising a spring member acting upon said retainer, wherein said retainer is moveable along said guide shaft against the bias force of said spring member.

13. An arrow comprising an arrow shaft, a forwardly projecting arrow head, impact-enhancing means moveable freely within the arrow shaft between a proximal armed condition and a distal impact condition, wherein said impact-enhancing means is propelled from said armed condition and into said impact condition in response to an abrupt deceleration force of the arrow on impact of the arrow head with a target area, for thereby imparting a secondary impact force to said arrow head, and a proximal shock-absorber means which absorbs recoil impact of said impact-enhancing means.

14. The arrow of claim 13, wherein said impact-enhancing means includes a connector to connect said impact-enhancing means to both a distal end of said arrow shaft and a proximal end of said arrow head.

15. The arrow of claim 14, wherein said impact-enhancing means is in the form of a cylindrical tubular element.

16. The arrow of claim 14, wherein said impact-enhancing means is in the form of a ball.

17. A method of enhancing impact effect of an arrow head connected to an arrow shaft by an arrow head connector, said method comprising the steps of:

(a) arming an arrow for enhanced impact effect by positioning an impact-enhancing weight for free movement within the tubular arrow shaft of an arrow to be shot so that the weight is spaced from a rearward end of the arrow head connector;

(b) shooting the arrow at a target and allowing the arrow to strike the target to thereby responsively cause the impact-enhancing weight to be propelled forwardly within the arrow shaft and strike the arrow head connector, whereby the impact effect of the arrow head is enhanced, wherein step (a) includes briskly moving the arrow through a generally arcuate path to create sufficient centrifugal force to move the impact-enhancing weight within the arrow shaft to a position which is spaced from the rearward end of the arrow head connector.

18. The method of claim 17, wherein step (a) includes grasping the forward end of the arrow while manually moving the arrow through the generally arcuate path.

19. The method of claim 17, wherein the impact-enhancing weight is generally tubular and is sleeved over a guide rod contained within the arrow shaft, and wherein the weight is propelled forwardly guided by the guide rod in response to the arrow striking the target.

20. The method of claim 17, wherein the impact-enhancing weight is generally spherical and is positioned within a guide tube contained within the arrow shaft, and wherein the weight is propelled forwardly guided by the guide tube in response to the arrow striking the target.

21. The method of claim 17, wherein step (a) includes frictionally retaining the impact-enhancing weight within the arrow shaft in a position spaced from the arrow head connector.

22. An arrow comprising:

an arrow shaft, an arrow head attached at a forward end of said arrow shaft, and an impact-enhancing device in operative association with said arrow head, wherein said impact-enhancing device enhances kinetic energy of the arrow head in an amount of at least about 20% in response to a target strike with a velocity reduction of the arrow in flight of less than about 5% as compared to a comparable arrow not including the device, wherein said impact-enhancing device includes a guide shaft, and a generally tubular impact-enhancing weight moveably sleeved over the guide shaft so as to be freely moveable within said arrow shaft.

23. An arrow comprising:

an arrow shaft, an arrow head attached at a forward end of said arrow shaft, and an impact-enhancing device in operative association with said arrow head, wherein said impact-enhancing device enhances kinetic energy of the arrow head in an amount of at least about 20% in response to a target strike with a velocity reduction of the arrow in flight of less than about 5% as compared to a comparable arrow not including the device, wherein said impact-enhancing device includes a guide tube, and a generally spherical impact-enhancing weight moveably received within the guide tube so as to be freely moveable within said arrow shaft.

24. A device to enhance impact of an arrow comprising:

a distal connector adapted to being operatively coupled to a distal end of an arrow shaft and to a forwardly projecting arrow head, an impact-enhancing weight adapted to be freely moveable within the arrow shaft to forcibly strike the connector in response to an abrupt deceleration force of the arrow, and a guide shaft connected at a distal end thereof to said connector and having a retainer ring at a proximal end thereof.

25. The device of claim 24, wherein said impact-enhancing weight is generally cylindrical and sleeved over said guide shaft for movement between a proximal armed position, wherein the weight is frictionally, but releasably, retained by said retainer ring, and a distal impact position, wherein the weight impacts said connector.

26. The device of claim 25, further comprising a spring member acting upon said retainer ring, wherein said retainer ring is moveable along said guide shaft against the bias force of said spring member.

27. A device to enhance impact of an arrow comprising:

a distal connector adapted to being operatively coupled to a distal end of an arrow shaft and to a forwardly projecting arrow head, an impact-enhancing weight adapted to be freely moveable within the arrow shaft to forcibly strike the connector in response to an abrupt deceleration force of the arrow, and a guide tube connected at a distal end thereof to said connector and having a retainer at a proximal end thereof to frictionally, but releasably, retain said impact-enhancing weight, and wherein said impact-enhancing weight is a ball which is freely moveable within said guide tube.

28. The device of claim 27, further comprising a spring member acting upon said retainer, wherein said retainer is moveable along said guide shaft against the bias force of said spring member.

29. An arrow comprising:

an elongate arrow shaft having an arrow head at a distal end of the arrow shaft, and arrow feathers at a proximal end of the arrow shaft; and an impact-enhancing device operatively connected to the distal end of the arrow shaft rearwardly of the arrow head, said impact-enhancing device including, (i) a distal connector which is connected to said distal end of said arrow shaft and to said arrow head, (ii) an impact-enhancing weight freely moveable within said arrow shaft to forcibly strike the connector in response to the arrow head striking a target area, and (iii) a guide shaft connected at a distal end thereof to said connector and having a retainer ring at a proximal end thereof.

30. The device of claim 29, wherein said impact-enhancing weight is generally cylindrical and sleeved over said guide shaft for movement between a proximal armed position, wherein the weight is frictionally, but releasably, retained by said retainer ring, and a distal impact position, wherein the weight impacts said connector.

31. The device of claim 30, further comprising a spring member acting upon said retainer ring, wherein said retainer ring is moveable along said guide shaft against the bias force of said spring member.

32. An arrow comprising:

an elongate arrow shaft having an arrow head at a distal end of the arrow shaft, and arrow feathers at a proximal end of the arrow shaft; and an impact-enhancing device operatively connected to the distal end of the arrow shaft rearwardly of the arrow head, said impact-enhancing device including, (i) a distal connector which is connected to said distal end of said arrow shaft and to said arrow head, (ii) an impact-enhancing weight freely moveable within said arrow shaft to forcibly strike the connector in response to the arrow head striking a target area, and (iii) a guide tube connected at a distal end thereof to said connector and having a retainer at a proximal end thereof to frictionally, but releasably, retain said impact-enhancing weight, and wherein said impact-enhancing weight is a ball which is freely moveable within said guide tube.

33. The device of claim 32, further comprising a spring member acting upon said retainer, wherein said retainer is moveable along said guide shaft against the bias force of said spring member.

* * * * *